United States Patent [19]

Hague

[11] Patent Number: 4,486,998

[45] Date of Patent: Dec. 11, 1984

[54] CONCEALED FASTENER ROOF OR WALL STRUCTURE AND METHOD OF ASSEMBLY

[75] Inventor: James G. Hague, Mars, Pa.

[73] Assignee: H. H. Robertson Company, Pittsburgh, Pa.

[21] Appl. No.: 376,169

[22] Filed: May 7, 1982

[51] Int. Cl.[3] ..... E04D 1/34; E04D 3/363

[52] U.S. Cl. ..... 52/478; 52/520; 52/536; 52/544

[58] Field of Search ..... 52/478, 520, 543, 544, 52/546, 529, 530, 536, 394, 395

[56] References Cited

U.S. PATENT DOCUMENTS

| | | | |
|---|---|---|---|
| 463,649 | 11/1891 | Rollins | 52/521 |
| 2,765,887 | 10/1956 | Horowitz | 52/520 |
| 3,232,018 | 2/1966 | MacKean | 52/714 |
| 3,716,958 | 2/1973 | Scrivener | 52/713 |
| 3,796,014 | 3/1974 | Garbick | 52/573 |
| 3,852,929 | 12/1974 | Cookson | 52/543 |
| 3,867,742 | 2/1975 | Austin | 24/336 |
| 3,973,367 | 8/1976 | Johnson et al. | 52/573 |
| 3,998,019 | 12/1976 | Reinwall, Jr. | 52/573 |
| 4,271,653 | 6/1981 | Buchhorn | 52/553 |
| 4,285,182 | 8/1981 | Dinges | 52/47 B |
| 4,400,922 | 8/1983 | Boyer | 52/543 |

FOREIGN PATENT DOCUMENTS

| | | | |
|---|---|---|---|
| 986679 | 4/1976 | Canada | 52/544 |
| 447814 | 5/1949 | Italy | 52/543 |

*Primary Examiner*—Alfred C. Perham
*Attorney, Agent, or Firm*—G. E. Manias

[57] ABSTRACT

A concealed fastener arrangement useful in attaching a succession of profiled panel members to spaced-apart structural elements of a building framework to provide roof or wall structures. The arrangement includes repeating series of fixed and movable clip means secured to the structural elements in predetermined pattern. Adjacent ones of the fixed clip means are spaced-apart at a selected modular width corresponding to the desired panel coverage width. Plural movable clip means are presented between adjacent fixed clip means, and are capable of limited movement longitudinally of the structural elements. When assembled in side-by-side overlapped relation, the panel members present downwardly opening, longitudinal ribs including joint ribs formed by overlapping the complimentary male and female partial ribs of adjacent panel members. The fixed and movable clip means are received within the longitudinal ribs and connect the panel members to the structural elements. The concealed fastener arrangement is such that during installation, the manufactured width of the panel members—if different from the modular width—is conformed with the modular width by transverse expansion or contraction of the panel member. The movable clip means move into centered relation with the associated ribs thereby relieving any stresses which may have been created during forced expansion or contraction of the panel member.

6 Claims, 12 Drawing Figures

W±T
W-T
W+T
M
50
50A
50B
50C
8

CONCEALED FASTENER ROOF OR WALL STRUCTURE AND METHOD OF ASSEMBLY

BACKGROUND OF THE INVENTION

1. Field of the Invention

This invention relates to concealed fastener roof or wall structures, and more particularly to an improved concealed fastening arrangement for conforming the width of each panel member with a selected modular width during installation of the panel members.

2. Description of the Prior Art

Roof and wall structures are known wherein plural panels are assembled in side-by-side overlapped relation and secured in place by concealed fastening means entirely from beneath the panels and without requiring holes of any kind in the panels. Such an arrangement provides a structure which is leakproof.

Recent innovations in concealed fastening arrangements provide roof or wall structures using relatively wide panel members, e.g., 36" wide. Such panel members have downwardly opening, lengthwise extending, intermediate ribs. and complimentary partial ribs along opposite longitudinal edges thereof. The partial ribs are interfittable with complimentary partial ribs of adjacent panels to form joint ribs duplicating the cross-sectional configuration of the intermediate ribs. A first of such innovations is disclosed in U.S. Pat. No. 4,285,182 (DINGES). DINGES discloses a panel construction for roofs or walls which utilizes locating strips applied along the structural elements for temporarily locating the clips at uniformly spaced positions corresponding with the spacing of the intermediate and joint ribs of subsequently applied panel members. The clips and locater strips are secured to the structural elements by positive fasteners. Thereafter, the panel ribs are forced onto the clips by pressure applied to the top surfaces of the panels. The locater strip is intended to preclude rib-to-clip and joint-to-clip misalignment. The DINGES arrangement performs satisfactorily only if the spacing of the complimentary partial ribs and the intermediate ribs corresponds substantially to the clip spacing defined by the locater strip.

A second of such innovations is disclosed in copending application Ser. No. 249,062 (BOYER) filed Mar. 30, 1981 and assigned to the assignee of this invention and now U.S. Pat. No. 4,400,922. BOYER discloses a two-piece clip assembly configured to accommodate thermal movement of the panel members, that is expansion and contraction due to temperature changes. The two-piece clip assemblies also are configured to accommodate any joint-to-clip and rib-to-clip misalignment. The clip assemblies include base members secured to the structural elements at uniformly spaced locations therealong; and floating top clips capable of limited movement relative to the base members in a direction transverse to the panel ribs. The floating top clips accommodate minor variations in rib spacing and possible misalignment of the clips with respect to the ribs with which they must engage. The floating top clips center themselves within the ribs thereby minimizing drag between the clip and the panel during thermal movement of the panel; and thereby maximizing the hold-down capacity of the clips under wind uplift conditions.

Panel members are fabricated by roll forming operations to established manufacturing tolerances to provide, for example, a 36" (91.44 cm) coverage width. However, the actual coverage width of the panel members may vary from the intended 36" coverage width, by as much as ±3/16" (±0.476 cm). The variations in coverage width may be caused by variations in the thickness of the sheet metal and of the decorative coating which must be accommodated by the rolls of the roll forming equipment; and by coil-to-coil variations in the physical properties of the steel. These variations cause varying degrees of permanent set and spring back in the material being roll formed thereby causing variations in the final shape of the ribs and hence in the coverage width. Since the panel coverage cannot be precisely controlled at the time of manufacture, any roof or wall installation must be engineered assuming 36" coverage width. The panels must be installed to provide the 36" coverage width regardless of the actual manufactured panel width. This can be accomplished in profiled panels by "moduling" the panel member, that is by physically stretching or compressing the panel to conform its width to the engineered width.

It appears that the DINGES clip arrangement cannot accommodate panel width variation without introducing undesirable assymetrical stresses which would compromise the holddown capacity of the clip and which may cause jamming during thermal movement of the panel.

The BOYER arrangement is intended to accommodate minor panel width variations since the floating top clip is capable of movement transversely of the panel ribs. However, any rib-to-clip and joint-to-clip misalignment caused by clip spacing errors created during clip installation, combined with panel width variations may cause the top clips to be jammed to one side of the base members. The jamming may cause the clips to bind in the ribs during thermal movement of the panel, and may reduce the hold-down capacity of the clip assemblies. If all of the top clips must be moved in the same direction because of width variations in the previously installed panels, the remaining top clips may not be capable of accommodating variations in manufacturing tolerances and in panel widths.

SUMMARY OF THE INVENTION

The present invention constitutes an improvement over the concealed fastener arrangement disclosed and claimed in the aforesaid copending U.S. patent application Ser. No. 249,062, now U.S. Pat. No. 4,400,922.

The principal object of this invention is to provide an improved concealed fastener arrangement of fixed and movable anchor clips for wall or roof structures, by which odd-width panel members are conformed to the desired panel coverage-conformation being achieved without sacrificing the lateral movement capability of the movable anchor clips; without introducing substantial assymetrical stresses between the fixed anchor clips and ribs; without inhibiting thermal movement of the panel member; and without compromising the hold-down capacity of the anchor clips.

Another object of this invention is to provide a two-piece anchor clip configured to allow two-step field installation thereof.

The present concealed fastener arrangement is useful in roof or wall structures of the type having horizontally extending structural elements, and plural panel members extending transversely of the structural elements and erected in side-by-side relation. The assembled panel members present alternating panel webs and upstanding, downwardly opening, longitudinal ribs including joint ribs formed from overlapped and interlocked complimentary partial ribs of adjacent panel members. Each of the ribs includes a crest, depending rib sidewalls, and spaced-apart inturned base portion connecting the rib sidewalls to the adjacent ones of the panel webs—the spaced-apart inturned base portions providing shoulders engageable by clip means.

In accordance with this invention, fixed clip means are secured to the structural elements in spaced-apart relation and such that adjacent fixed clip means are spaced-apart at a selected modular width corresponding to the engineered coverage width. Plural movable clip means are secured to the structural elements between adjacent ones of the fixed clip means, and at a spacing which corresponds to the longitudinal rib spacing. Thus positioned, each fixed clip means connects corresponding longitudinal ribs of the panel members to the structural elements, whereas the movable clip means connect the remaining longitudinal ribs of all panels to the structural elements. The overall arrangement is such that any panel member exhibiting a panel width different from the modular width will be transversely expanded or contracted during installation to conform the panel width to the modular spacing. Meanwhile each of the movable clip means undergoes limited movement longitudinally of the structural elements into registry with the associated longitudinal rib during any expansion or contraction of the panel member. The concealed fastener arrangement maintains the engineered coverage width without sacrificing the lateral movement capability of the movable clip means. Since all of the clip means are essentially centered within the associated longitudinal rib, detrimental assymetrical stresses between the movable clip means and rib are avoided. Furthermore, thermal movement of the panel members is not inhibited and the holddown capacity of the clip means is not compromised. Any assymetrical stresses which are created during installation, are isolated in the fixed clip means-to-rib connection. However, installation of a plurality of the panel members tends to minimize stresses in the fixed clip means-to-rib connection because of the tendency of the rib to center itself over the fixed clip means and because of laterally outwardly directed spring pressure applied to the rib by a spring steel top clip element of the fixed clip means.

The foregoing and other objects and advantages will become readily apparent to persons skilled in the art from the following detailed description by reference to the accompanying drawings in which:

DESCRIPTION OF THE PREFERRED EMBODIMENT(S)

Figures 1, 2, 3:
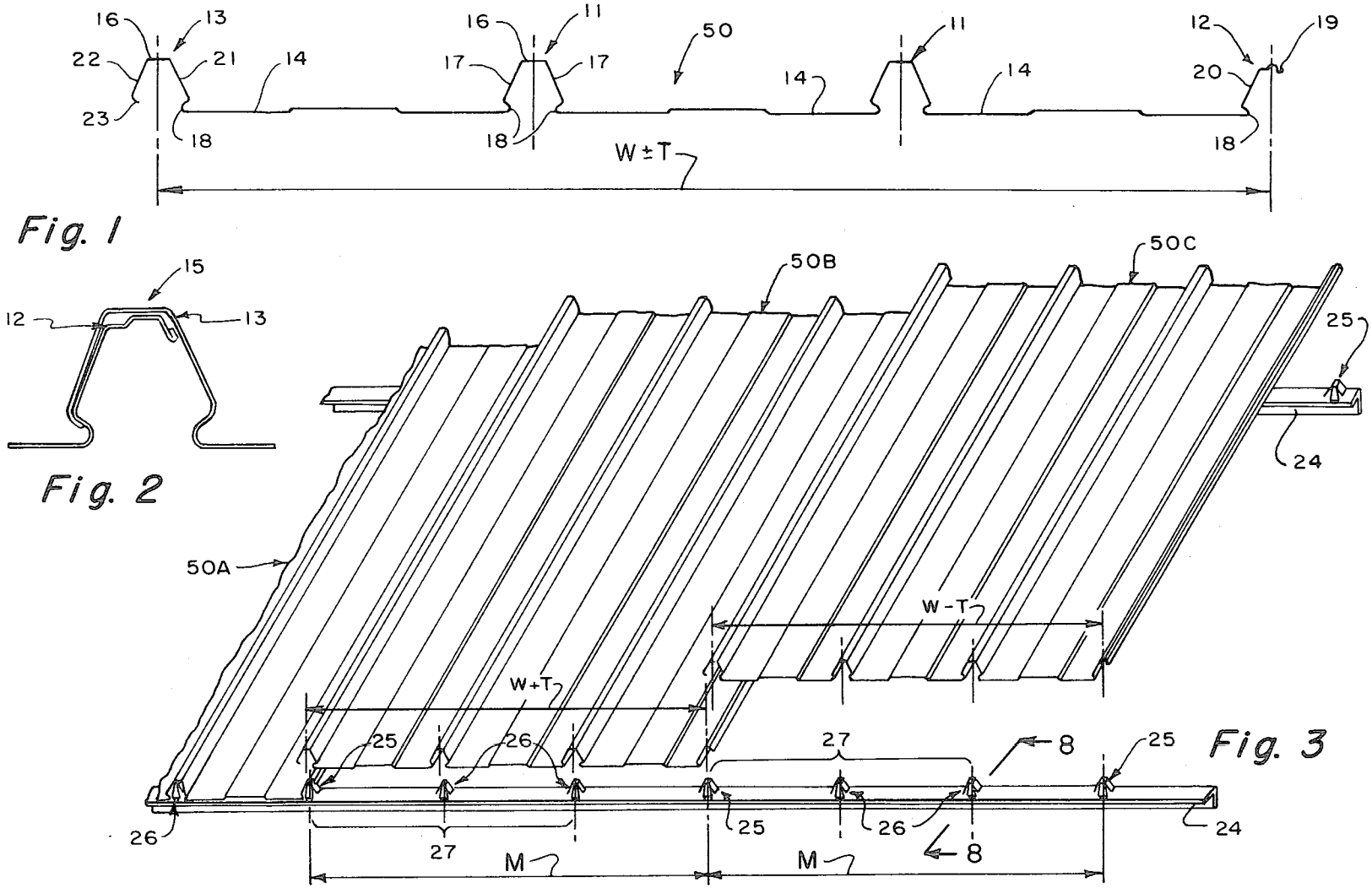
FIG. 1 is an end view of a panel member.
FIG. 2 is a fragmentary end view of a joint rib.
FIG. 3 is a fragmentary isometric view, in exploded form, illustrating relationships between odd-width panel members and clip means secured to structural elements.

FIG. 1 illustrates, in end elevation, a panel member 50 presenting upstanding intermediate ribs 11, male and female partial ribs 12, 13 along opposite longitudinal edges of the panel 50, and panel webs 14 connecting adjacent ones of the ribs 11, 12, 13. Each of the partial ribs 12, 13 is overlappable and interfittable with a complimentary partial rib 13, 12 of an adjacent panel member to provide a joint rib 15 (FIG. 2) having a cross-sectional configuration duplicating that of the intermediate ribs 11. Each of the intermediate ribs 11 includes a crest 16, depending rib sidewalls 17 and spaced-apart inturned base portions 18 connecting the rib sidewalls 17 to adjacent ones of the panel webs 14. The male partial rib 12 presents a stepped crest 19, a depending sidewall 20, and an inturned base portion 18 connecting the sidewall 20 to the adjacent panel web 14. The female partial rib 13 presents a crest 16 and depending sidewalls 21, 22. The depending sidewall 21 is connected to the adjacent panel web 14 by an inturned base portion 18. The sidewall 22 terminates in an arcuate hug edge portion 23.

The panel member 50 may be fabricated by a roll forming operation to a selected width hereinafter referred to as the manufactured width W. Because of non-uniformities in the thickness of the sheet metal and of the decorative coating; and differences in the coil-to-coil physical properties of the sheet metal, the panel member 50 is fabricated to a manufactured width $W\pm$ a given tolerance T. In FIG. 1, the manufactured width is indicated by $W\pm T$.

FIG. 3 illustrates spaced-apart, generally parallel structural elements 24 of a building framework. It is to be understood that the concealed fastening arrangement of this invention may be used in either roof structures or wall structures. Thus the structural elements 24 may comprise roof purlins or wall girts to which a plurality of the panel members 50 are secured.

In accordance with the principles of this invention, a plurality of fixed clip means 25 are secured to each of the structural elements 24 at uniformly spaced locations therealong. The centerline-to-centerline distance between adjacent ones of the fixed clip means 25 corresponds to the engineered coverage width and is hereinafter referred to as the modular width and is indicated by M. Plural movable clip means 26 are secured to each of the structural elements 24. In the arrangement of FIG. 3, two movable clip means 26 are provided between each pair of adjacent fixed clip means 25. Thus, each of the structural elements 24 presents repeating series or sets 27 of a clip means, each series or set 27 including one of the fixed clip means 25 and a plural movable clip means 26.

For the purposes of discussion, FIG. 3 illustrates a first panel member 50A installed on the structural elements 24, and second and third panel members 50B, 50C positioned for installation.

The second panel member 50B is an over-width panel member having a manufactured width of $W+T$. When installed, the second panel member 50B must be transversely compressed in order to conform the width of the second panel member 50B with the modular width M. The third panel member 50C is an under-width panel member having a manufactured width of W−T. The second panel member 50C must undergo transverse expansion to conform the width thereof with the modular width M. As will be described, the under-width panel member 50C is installed in the same manner as a normal panel member having a manufactured width W equal to the modular width M. The under-width panel member 50C will be transversely expanded during installation of the next panel member.

Figure 6:
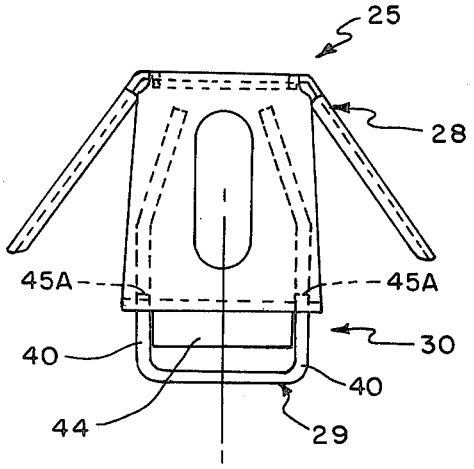
FIG. 6 is an end view of fixed clip means.
Figure 7:
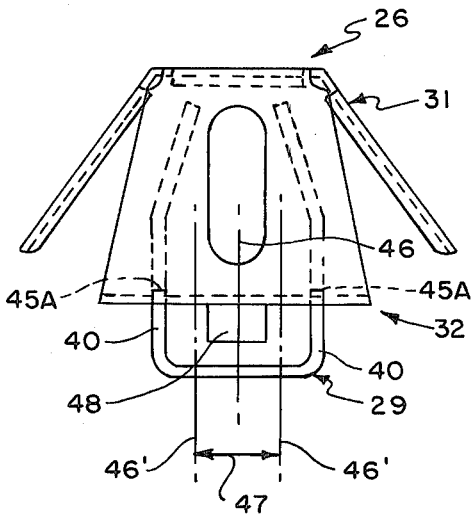
FIG. 7 is an end view of movable clip means.

Referring to FIGS. 6 and 7, the fixed and movable clip means 25, 26 are similar to the panel mounting clip assembly disclosed in the aforesaid copending application Ser. No. 249,062 (now U.S. Pat. No. 4,400,922). The fixed clip means 25 (FIG. 6) includes a top clip 28, a cooperating base member 29 and a first coupling means 30 connecting the top clip 28 to the base member 29 in substantially immovable relationship therewith. The movable clip means 26 (FIG. 7) includes a similar top clip 31, an identical cooperating base member 29, and a second coupling means 32 connecting the top clip 31 to the base member 29 for limited movement transversely of the base member 29.

Figure 4:
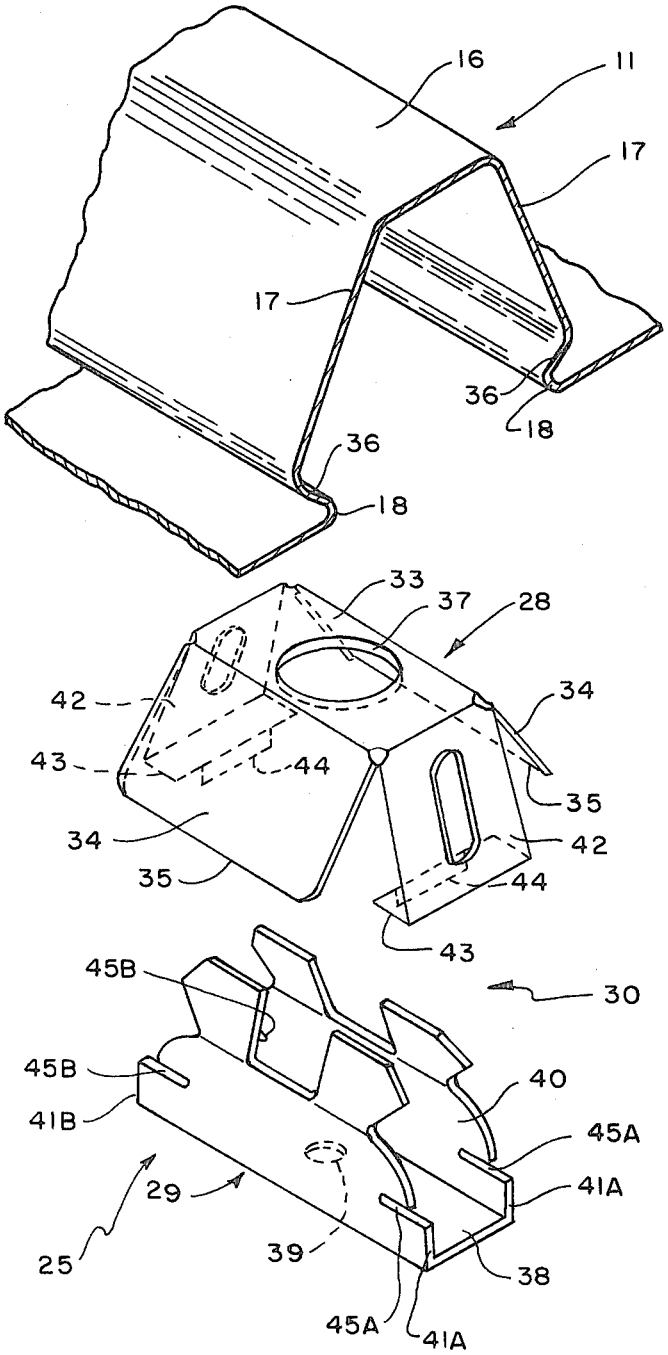
FIG. 4 is an isometric view, in exploded form, illustrating a two-piece fixed clip means in relation to a panel rib.

While FIG. 4 illustrates the top clip 28 and the base member 29 constituting the fixed clip means 25, in combination with the intermediate rib 11, the fixed clip means 25 preferably is employed at a joint rib 15 (FIG. 2) as will be described.

Referring to FIG. 4, the top clip 28 includes an upper wall 33 which may have a generally rectangular configuration. Clamping wings 34 depend from opposite sides of the upper wall 33 and terminate in clamping edges 35. The clamping edges 35 extend generally parallel with the length of the intermediate rib 11 and are positioned to engage interior surfaces of the longitudinal rib 11, such as the shoulders 36 of the inturned base portions 18. The top wall 33 is provided with a tool-receiving access opening 37 of a size sufficiently large to pass a fastener applying tool, as will be described.

The base member 29 comprises a generally U-shaped clip including a web or bottom wall 38 having a central fastener receiving opening 39, and upstanding sidewalls 40 presenting first adjacent end faces 41A and second adjacent end faces 41B (only one visible in FIG. 4) at opposite ends thereof.

The first coupling means 30 comprises elements provided in part by the top clip 28 and in part by the base member 29. The top clip 28 presents connecting wings 42 depending from opposite ends of the top wall 33, generally coplanar terminal flanges 43 extending inwardly of the connecting wings 42 and toward one another, and relatively wide tabs 44 depending downwardly from the confronting edges of the terminal flanges 43. The sidewalls 40 of the base member 29 present first flange-receiving slots 45A extending inwardly from the first adjacent end faces 41A, and second flange-receiving slots 45B extending inwardly from the second adjacent end faces 41B.

Figure 5:
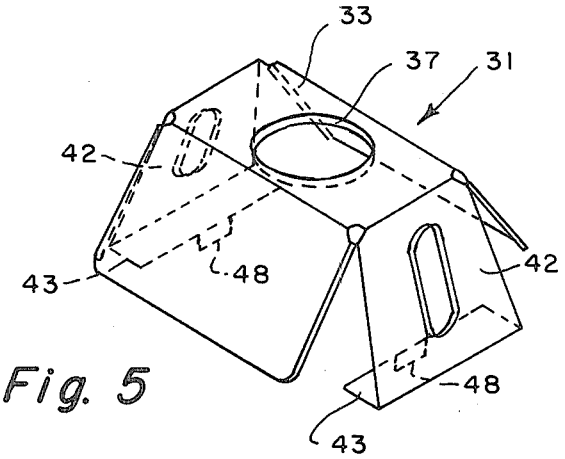
FIG. 5 is an isometric view of a top clip utilized with movable clip means.

The top clip 31 (FIG. 5) of the movable clip means 26 is similar to the top clip 28. Corresponding numerals will be employed to identify corresponding parts heretofore described. The second coupling means 32 includes elements provided in part by the top clip 31 and in part by the associated base member 29. That is, the top clip 31 presents connecting wings 42 depending from opposite ends of the top wall 33 and terminating in inturned terminal flanges 43. The top clip 31 differs from the top clip 28 by presenting relatively narrow tabs 48 depending downwardly from the confronting edges of the terminal flanges 43. The first and second flange-receiving slots 45A, 45B of an associated base member 29 constitutes elements of the second coupling means.

Figure 8:
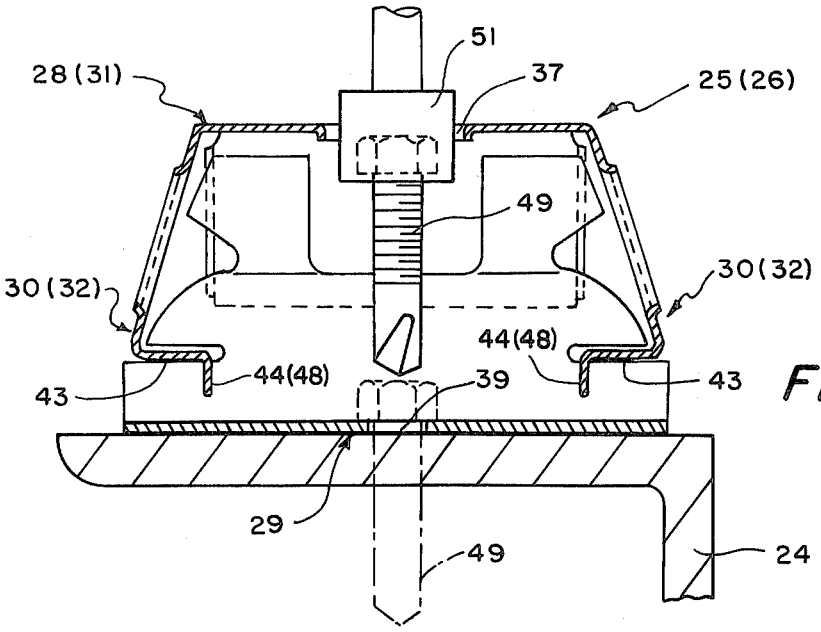
FIG. 8 is a cross-sectional view taken along the line 8—8 of FIG. 3, illustrating the method of securing fixed or movable clip means to a structural element.

FIG. 8 best illustrates the assembled fixed or movable clip means 25, 26. The terminal flanges 43 of the top clip 28 (31) reside within the first and second flange-receiving slots of the base member 29. The flange-to-slot connections comprise the first and second coupling means 30 (32).

As best shown in FIG. 6, the tabs 44 (only one visible) of the fixed clip means 25, reside between the sidewalls 40 of the base member 29. However, the width of the tabs 44 is substantially equal to the distance between the interior surface of the sidewalls 40. Thus the tabs 44 preclude any transverse movement of the top clip 28 relative to the base member 29 and maintain the top clip in 28 in substantially immovable relationship therewith.

The top clip 31 of the movable clip means 26 (FIG. 7) is capable of limited movement transversely of the base member 29. The terminal flanges 43 and the slots 45A, 45B (see FIG. 8) cooperate to guide the top clip 31 during its transverse movement. As best seen in FIG. 7, the top clip 31 possesses bilateral symmetry about a vertical plane represented by the dash-dot line 46. The tabs 44 (only one visible) residing between the sidewalls 40, are positioned to engage either of the inner faces of the sidewalls 40 thereby limiting the transverse movement of the top clip 31 relative to the base member 29 to the extreme positions represented by the dash-dot vertical planes 46'. In a commercial embodiment of the movable clip means 26, the top clip 31 is movable through a total transverse distance 47 of $\frac{3}{8}$".

Each of the top clips 28, 31 may be formed from spring steel having a thickness of from 18 gauge (1.214 mm) to about 22 gauge (0.760 mm).

The provision of the tool-receiving opening 37 in the top wall 33 of the top clips 28, 31 simplifies the installation procedure. That is, the clip means 25, 26 may be secured to the structural elements 24 by a single two-step operation. That is, as shown in FIG. 8, the clip means 25 (26) is positioned at the desired location on the structural element 24. A positive fastener, preferably of the selftapping type, is carried within a thin wall socket 51 of a power tool. The fastener 49 and socket 51 are introduced through the opening 37. Operation of the power tool will drive the fastener 49 through the access opening 39 into the structural element 24, thereby securing the clip means 25 (26) to the structural element 24. For the purposes of illustrations, the positive fastener 49 is shown in dash-dot outline in its fastening position.

Figure 9A:
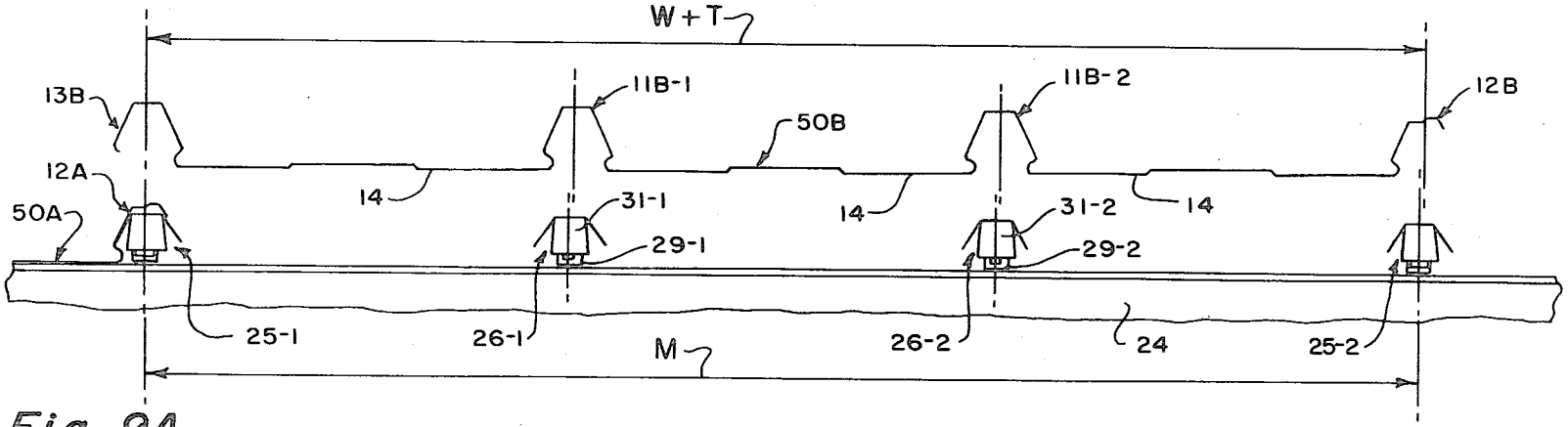
FIGS. 9A and 9B are schematic end elevation views illustrating conformation of an over-width panel member with the selected modular width.
Figure 9B:
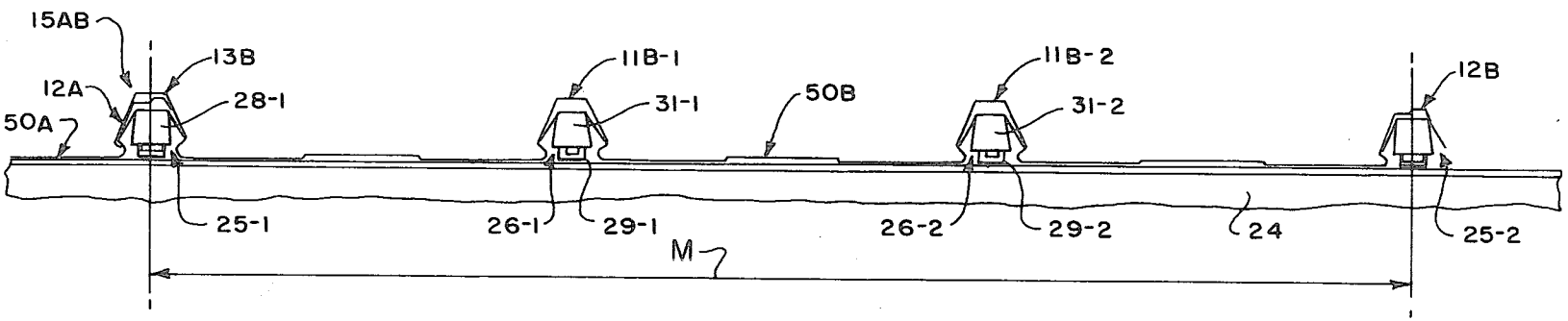

FIGS. 9A and 9B illustrate the installation of the over-width panel member 50B having a manufactured width W+T which is greater than the modular width M. The panel member 50B must undergo transverse contraction during installation, to conform the manufactured width to the modular width M. The contraction is accomplished through an accordioning action wherein the intermediate ribs 11B and the partial ribs 12B, 13B acting as hinges, allow the panel webs 14 to move closer to one another. It will be appreciated that the adjacent clip means 25-1, 25-2 are rigidly fixed relative to the structural element 24 and determine the installed positions of the partial ribs 12B, 13B.

The intermediate and partial ribs 11, 12, 13 of the panel member 50B may be installed onto the associated clip means 25, 26 in any order. However, to utilize the previously installed panel member 50A as a working surface, the sheet 50B may be installed as follows. The female partial rib 13B is forced into connected relation with the male partial rib 12A and the fixed clip means 25-1 by pressure exerted on the top surface thereof. Thereafter, the adjacent intermediate rib 11B-1 is forced into connected relation with the associated movable clip means 26-1 by pressure exerted on the top surface thereof. The top clip 31-1 thereof will move laterally to the right of FIG. 9A and center itself with the intermediate rib 11B-1. The adjacent intermediate rib 11B-2 is forced onto the associated movable clip means 26-2 in the manner just described. Finally, the male partial rib 12B is forced into connected relation with the fixed clip means 25-2 by pressure exerted on the upper surface thereof. FIG. 9B illustrates the over-width panel member 50B after installation and after transverse contraction has been accomplished. It should be noted that the adjacent fixed clip means 25-1, 25-2 being stationary relative to the structural element 24, force the panel member 50B to contract transversely and to thereby conform the manufactured width W+T thereof to the modular width M. During contraction, the top clips 31-1, 31-2 shift to the left of FIGS. 9A, 9B into centered relation relative to the intermediate ribs 11B-1, 11B-2; and into essentially centered relation relative to the base members 29-1, 29-2.

Figure 10A:
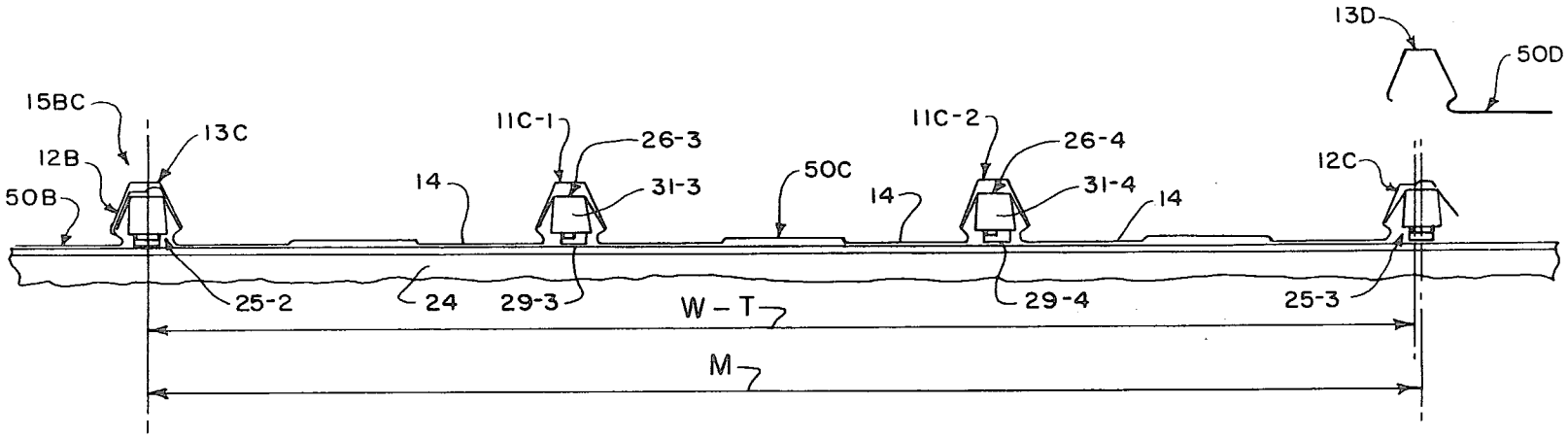
FIGS. 10A and 10B are schematic end elevation views illustrating the conformation of an under-width panel member with the sected modular width.
Figure 10B:
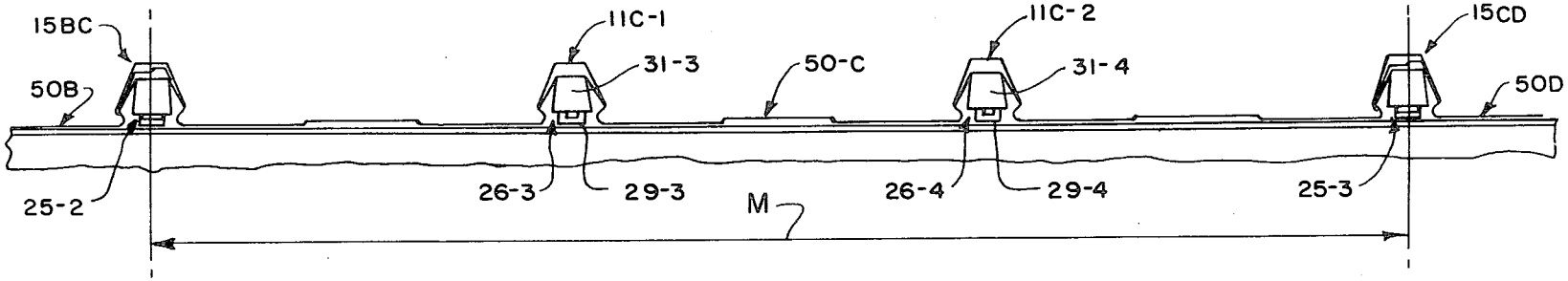

FIGS. 10A and 10B illustrate the installation of the under-width panel member 50C having a manufactured width W−T which is less than the modular width M. It will be observed in FIG. 10A that the female partial rib 13C is forced into connected relation with the male partial rib 12B and the fixed clip means 25-2 by pressure applied on the upper surface thereof. The intermediate ribs 11C-1, 11C-2 are likewise forced into connected relation with the associated movable clip means 26-3, 26-4 in the same manner. The male partial rib 12C is connected to the fixed clip means 25-3 but, due to the lesser width of the panel member 50C, has its vertical center plane offset from the vertical center plane of the fixed clip means 25-3. Note also that the top clips 31-3, 31-4 of the movable clip means 26-3, 26-4 are offset relative to the base members 29-3, 29-4 to the left of FIG. 10A. Accordioning of the under-width panel member 50C occurs during the installation of the next-to-be installed panel 50D. It will be noted by comparing FIGS. 10A and 10B, that as the female partial rib 13D of the adjacent panel member 50D is forced into connected relation with the male partial rib 12C and the fixed clip means 25-3, the under-width panel member 50C is transversely stretched. As can be seen in FIG. 10B, the top clips 31-3, 31-4 of the movable clip means 26-3, 26-4 are essentially centered with respect to the base members 29-3, 29-4. In FIG. 10B, the manufactured width W−T of the panel member 50C has been made to conform with the modular width M.

It should be understood from the foregoing description that the connections between the intermediate ribs 11 and the associated movable clip means 26 are substantially free of assymetrical stresses. This should be evident from the fact that the top clips 31 are free to move relative to the base members 29 into centered relation with the intermediate ribs 11. Any assymetrical stresses created during installation of adjacent panel members 50, are isolated at the connection between the joint rib 15 and the associated fixed clip means 25. However, the installation of a plurality of the panel members 50 tends to minimize stresses at the joint ribs 15 because of the tendency of the overlapped partial ribs 12, 13 to center themselves over the fixed clip means 25, and because of the laterally outwardly directed spring pressure applied by the clamping wings 34 (FIG. 4) to the overlapped partial ribs 12, 13.

I claim:

1. In a barrier structure having spaced-apart horizontally extending structural elements, plural panel members extending transversely of said structural elements and being erected in side-by-side relation, said panel members presenting alternating panel webs and downwardly opening longitudinal ribs including joint ribs comprising overlapped and interlocked complimentary partial ribs of adjacent panel members, each of said ribs including a crest, depending sidewalls, and spaced-apart inturned base portions connecting said rib sidewalls to adjacent ones of said panel webs, the improvement comprising:

each of said structural elements presenting sequentially arranged sets of uniformly spaced clips secured thereto, each of said sets including a fixed clip immovably secured to the structural element and plural movable clips, each capable of limited movement longitudinally of the structural element, the fixed clips of adjacent ones of said sets being spaced-apart at a distance corresponding to a selected modular width;

the fixed clips of said structural elements being aligned relative to each other transversely of said structural elements;

said clips being slidably connected to said ribs thereby to permit thermal movement of said panel members relative to said clips and transversely of said structural elements;

corresponding longitudinal ribs of said panel members being connected to the fixed clips of said sets whereby any of said panel members having a panel width different from said modular width undergo transverse expansion or contraction to conform the panel width to said modular width, and said movable clips undergo limited movement longitudinally of said structural elements into registry with the associated longitudinal ribs thereby to relieve stresses introduced into the panel by transverse expansion and contraction thereof.

2. The barrier structure defined in claim 1 wherein said corresponding longitudinal ribs comprise said joint ribs.

3. The barrier structure defined in claim 1 or 2 wherein each of said clips comprises:

a top clip extending into the associated longitudinal rib and including clamping wings presenting clamping edges generally parallel with the associated rib and engaged with said inturned base portions; and a base member secured to the structural element;

said fixed clips each including first coupling means connecting the top clip to the base member in substantially immovable relationship therewith; and said movable clips including second coupling means connecting the top clip to the base member for limited movement relative thereto and longitudinally of said structural elements.

4. The barrier structure defined in claim 1 or 2 wherein each of said clips comprises:

a top clip including a top wall and depending clamping wings engaged with said inturned base portion;

a generally U-shaped base member including a bottom wall and upstanding sidewalls disposed between said clamping wings;

coupling means connecting said top clip to said base member;

a positive fastener extending through and securing said bottom wall to said panel support member; and an access opening in said top wall, of a size sufficiently large to pass a tool for applying said positive fastener.

5. The method of attaching to the spaced-apart elongated structural elements of a building a succession of panel members each having intermediate ribs separated by panel webs and including complimentary partial ribs along opposite longitudinal edges thereof which are overlappable and interfittable with complimentary partial ribs of adjacent panels to provide joint ribs of like cross section, which method comprises:

(a) securing fixed clips to said structural elements, adjacent fixed clips being spaced-apart at a selected modular width, being aligned transversely of said structural elements relative to one another, and being immovable relative to said structural elements;

(b) securing movable clips to said structural elements at substantially uniformly spaced locations intermediate of adjacent ones of said fixed clips thereby to provide sequentially arranged sets of clips each including one of said fixed clips, said movable clips being capable of limited movement longitudinal of said structural element;

(c) forcing ribs and partial ribs on a first panel into connected relation with one of said sets of clips by pressure exerted on the top surface of the first panel member, which connected relation allows thermal movement of said first panel relative to said fixed clips and to said movable clips and transversely of said structural elements;

(d) placing a second panel over an adjacent set of clips with the partial rib thereof over a partial rib of said first panel member;

(e) thereafter forcing the partial rib of said second panel member into interfitted relation with the partial rib of said first panel and into connected relation with the clip associated therewith by pressure exerted on the top surface of the second panel member, and forcing the intermediate ribs of said second panel into connected relation with the clips of said adjacent set by pressure exerted on the upper surface of said second panel, which connected relation allows thermal movement of said second panel relative to said fixed clips and to said movable clips and transversely of said structural elements; and (f) repeating steps (d) and (e) for each successive panel, if any;

whereby panels having a panel width different from said modular width undergo transverse expansion or contraction to conform the panel width to said modular width, and said movable clips undergoing limited movement longitudinally of said structural elements thereby to relieve stresses introduced into the panel by transverse expansion and contraction thereof.

6. The method of claim 5 wherein said fixed clips reside in said joint ribs.

* * * * *